US005420672A

United States Patent [19]

Brewington et al.

[11] Patent Number: 5,420,672

[45] Date of Patent: May 30, 1995

[54] CONCEPT FOR PREVENTION OF SCAVENGELESS NIP WIRE CONTAMINATION WITH TONER

[75] Inventors: Grace T. Brewington, Fairport, N.Y.; Norman W. Czubaj, Jr., Pope Air Force Base, N.C.; Richard P. Germain, Webster; William H. Wayman, Ontario, both of N.Y.

[73] Assignee: Xerox Corporation, Stamford, Conn.

[21] Appl. No.: 176,595

[22] Filed: Jan. 3, 1994

[51] Int. Cl.[6] ..... G03G 15/08

[52] U.S. Cl. ..... 355/247; 118/654

[58] Field of Search ..... 355/245, 247, 248, 249, 355/259, 261; 118/653, 654

[56] References Cited

U.S. PATENT DOCUMENTS

| | | | |
|---|---|---|---|
| 4,078,929 | 3/1978 | Gundlach | 96/1.2 |
| 4,876,575 | 10/1989 | Hays | 355/259 |
| 4,984,019 | 1/1991 | Folkins | 355/215 |
| 4,990,958 | 2/1991 | Brewington et al. | 355/245 |
| 5,128,723 | 7/1992 | Bolte et al. | 355/259 |
| 5,134,442 | 7/1992 | Folkins et al. | 355/264 |
| 5,153,642 | 10/1992 | Folkins et al. | 355/215 |
| 5,153,647 | 10/1992 | Barker et al. | 355/245 |
| 5,204,719 | 4/1993 | Bares | 355/247 |
| 5,212,037 | 5/1993 | Julien et al. | 430/120 |
| 5,339,142 | 8/1994 | Hays | 355/259 |

*Primary Examiner*—A. T. Grimley
*Assistant Examiner*—Sandra L. Brasé

[57] ABSTRACT

A scavengeless/non-interactive development system using wire electrodes in a development nip between a donor member and a charge retentive surface. The wire electrodes are electrically biased for causing toner particles to form powder clouds in the development nip. Uniform powder clouds are ensured by effecting rubbing contact between the toner particles on a donor roll and a conductive surface.

8 Claims, 2 Drawing Sheets

CONCEPT FOR PREVENTION OF SCAVENGELESS NIP WIRE CONTAMINATION WITH TONER

BACKGROUND OF THE INVENTION

This invention relates to scavengeless development wherein a plurality of wire electrodes are positioned in a development zone intermediate a photoconductive imaging surface and a donor roll, and more specifically the present invention is directed to a method and apparatus for eliminating or minimizing toner accumulation on electrode wires and the accompanying uncontrolled powder clouding.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

After the electrostatic latent image is recorded on the photoconductive surface, it is developed by bringing a developer material into contact therewith. Two component and single component developer materials are commonly used.

A typical two component developer material comprises magnetic carrier granules having toner particles adhering triboelectrically thereto. A single component developer material typically comprises toner particles without the carrier granules. Toner particles are attracted to the latent image thereby forming a toner powder image on the photoconductive surface. The toner powder image is subsequently transferred to a sheet of plain paper. Finally, the toner powder image is subjected to a combination of heat and pressure to permanently fuse it to a final substrate in image configuration.

Single component development systems use a donor roll for transporting charged toner to a development zone or nip defined by the donor roll and photoconductive member. The toner is attracted to the latent image recorded on the photoconductive member by a combination of mechanical and/or electrostatic forces. Scavengeless development is one type of single component development. One type of scavengeless development system uses a donor roll with a plurality of electrode wires closely spaced therefrom in the development zone. An AC voltage is applied to the wires to create a toner cloud in the development zone. The electrostatic fields generated by the latent image attract toner from the toner cloud to develop the latent image. Single component development systems appear to offer advantages in low cost and design simplicity.

Two component development systems have been used extensively in many different types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages.

A combination of these systems was described at the 2nd International Congress on Advances in Non-impact Printing held in Washington, D.C. on Nov. 4–8, 1984, sponsored by the Society for Photographic Scientists and Engineers. At that time, Toshiba described a development system using a donor roll and a magnetic roller. The donor roll and magnetic roller were electrically biased. The magnetic roller transported a two component developer material to the nip defined by the donor roll and magnetic roller. Toner is attracted to the donor roll from the magnetic roll. The donor roll is rotated synchronously with the photoconductive drum with the gap between them being about 0.20 millimeters. The large difference in potential between the donor roll and latent image recorded on the photoconductive drum causes the toner to jump across the gap from the donor roll to the latent image so as to develop the latent image.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to 900 volts. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically 100 volts) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 volts) and is referred to as $V_{white}$ or $V_w$. The CAD developer is typically biased about 100 volts closer to $V_{cad}$ than $V_{white}$ (about 600 volts), and the DAD developer system is biased about 100 volts closer to $V_{dad}$ than $V_{white}$ (about 400 volts).

The viability of printing system concepts such as tri-level, highlight color xerography requires development systems that do not scavenge or interact with a previously toned image. Since commercial development systems such as conventional magnetic brush development and jumping single component development interact with the image receiver, a previously toned image will be scavenged by subsequent development. Since the present commercial development systems are highly interactive with the image bearing member, there is a need for scavengeless or non-interactive development systems.

U.S. Pat. No. 4,984,019 granted to Jeffery Folkins on Jan. 8, 1991 relates an apparatus in which an contaminants are removed from an electrode positioned between a donor roller and a photoconductive surface. A magnetic roller is adapted to transport developer material to the donor roller. The electrode is vibrated to remove contaminants therefrom.

U.S. Pat. No. 5,134,442 granted to Folkins et al on Jul. 28, 1992 relates to an apparatus in which a developer unit of an electrophotographic printing machine has a plurality of wires which trap contaminants before reaching electrode wires positioned between a donor roller and a photoconductive surface. In addition, a circuit determines when defects and deletions are caused by contaminants spacing the electrode wires from the donor roller.

U.S. Pat. No. 5, 153,642 granted to Folkins et al on Oct. 6, 1992 relates an apparatus in which an electrostatic latent image recorded on a photoconductive member is developed with developer material stored in a developer housing. The developer material advances along a path of travel to a development zone closely adjacent to the latent image. A cleaner, positioned in the path of the developer material and spaced from the photoconductive member, cleans contaminants from the developer material without impeding the flow thereof. The cleaner has a multiplicity of fibers disposed in the path of travel of the developer material.

U.S. Pat. No. 5,212,037 granted to Julien et al on May 18, 1993 relates to a process for avoiding, or minimizing toner contamination of electrodes in a scavengeless electrophotographic imaging apparatus which comprises adding to the donor roll present in said apparatus a toner comprised of resin, pigment,charge additive, and a metal oxide, or a mixture of metal oxides.

Metering/charging blade structures fabricated from EPDM which have been used in wire electrode scavengeless development systems exhibit two severe failure modes. The two failure modes are toner accumulation on electrode wires and the accompanying uncontrolled powder clouding in the nip or development zone. Accumulation of toner on electrode wires used for scavengeless development of prior art devices cause image development failure due to the formation of large agglomerates of toner particles on the wires. These, in turn, can cause imperfections and vacancies in the toner cloud leading to insufficient development on the image bearing member. This shows up as undesirable streaks on the final developed copies.

BRIEF SUMMARY OF THE INVENTION

The present invention is particularly useful for the scavengeless development apparatus forming a part of the subject matter of U.S. Pat. No. 4,868,600, the disclosure of which is totally incorporated herein by reference.

According to the present invention, the problems toner accumulation on wire electrodes and the accompanying uncontrolled powder clouding encountered using metering/charging blade structures fabricated from EPDM are obviated by using a conductive metering/charging surface. The conductive surface contacts a toner layer on a donor roll to modify its physical properties thereby enabling operation with AC biased nip wires without the adverse effects noted above. Prints having saturated solids, good background and good uniformity were created using the foregoing metering/charging arrangement.

Experiments were performed with 125 micron thick aluminized polyester film inserted between a blade and a donor roll with the conductive aluminum side facing and contacting the toner on the surface of the donor roll. The aluminum was electrically connected to the donor roll core bias voltage. A nip force of approximately 150 grams/cm. was applied between the conductive blade and the donor roll.

DETAILED DESCRIPTION OF THE PREFERRED EMBODIMENT OF THE INVENTION

Figure 2:
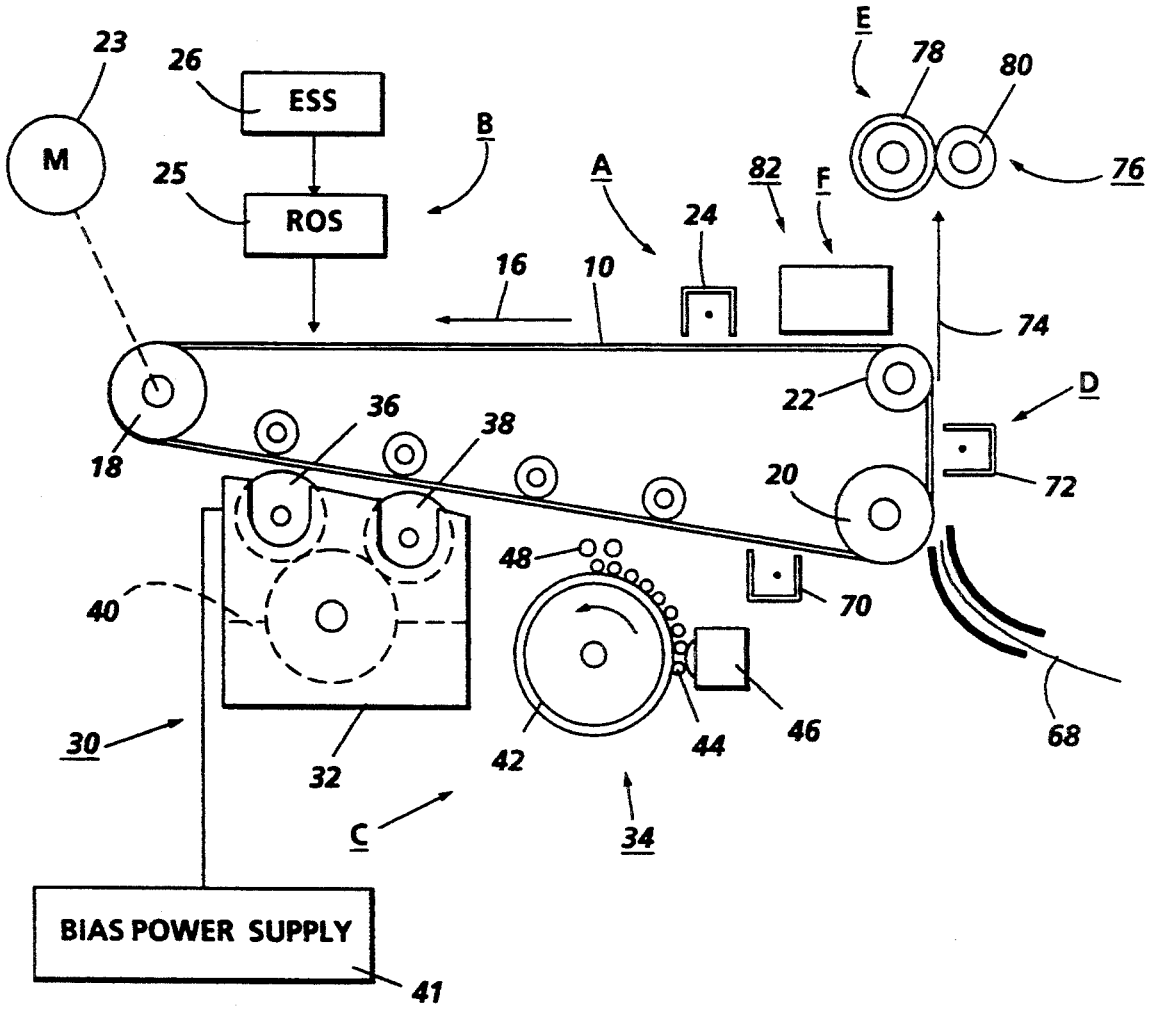
FIG. 2 PRIOR ART
FIG. 2 is a fragmentary schematic view of a development structure according to the invention.

As shown in FIG. 2, a highlight color printing machine in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 26 provides for control of the ROS as well as other subassemblies of the machine.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. See FIG. 1*a*. The photoreceptor is also discharged to $V_w$ equal to approximately −500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 37 via the power supply 41. With the foregoing bias voltage applied and the color toner suitably charged, discharged area development (DAD) with colored toner is effected.

The second developer apparatus 34 comprises a donor structure in the form of a roller 42. The donor structure 42 conveys developer 44, which in this case is a single component developer comprising black toner deposited thereon via a combination metering and charging device 46, to an area adjacent an electrode structure 48. The donor structure can be rotated in either the 'with' or 'against' direction vis-a-vis the direction of motion of the charge retentive surface. The donor roller 42 is preferably coated with TEFLON-S (trademark of E. I. DuPont De Nemours), phenolic or anodized aluminum.

The developer apparatus 34 further comprises an electrode structure 48 which is disposed in the space between the charge retentive surface 10 and the donor structure 42. The electrode structure is comprised of one or more thin (i.e. 50 to 100 μm diameter) wires which are positioned closely adjacent the donor structure 42. The distance between the wires and the donor is approximately 25 μm or the thickness of the toner layer on the donor roll. Thus, the wires are self-spaced from the donor structure by the thickness of the toner on the donor structure. For a more detailed description of the foregoing, reference may be had to U.S. Pat. No. 4,868,600 granted to Hays et al on Sep. 19, 1989.

A sheet of support material 68 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 70 is provided to condition the toner for effective transfer to a substrate using negative corona discharge.

Transfer station D includes a corona generating device 72 which sprays ions of a suitable polarity onto the backside of sheet 68. This attracts the charged toner powder images from the belt 10 to sheet 68. After transfer, the sheet continues to move, in the direction of arrow 74, onto a conveyor (not shown) which advances the sheet to fusing station E.

Fusing station E includes a fuser assembly, indicated generally by the reference numeral 76, which permanently affixes the transferred powder image to sheet 68. Preferably, fuser assembly 76 comprises a heated fuser roller 78 and a backup roller 80. Sheet 68 passes between fuser roller 78 and backup roller 80 with the toner powder image contacting fuser roller 78. In this manner, the toner powder image is permanently affixed to sheet 68. After fusing, a chute, not shown, guides the advancing sheet 68 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 82 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 1:
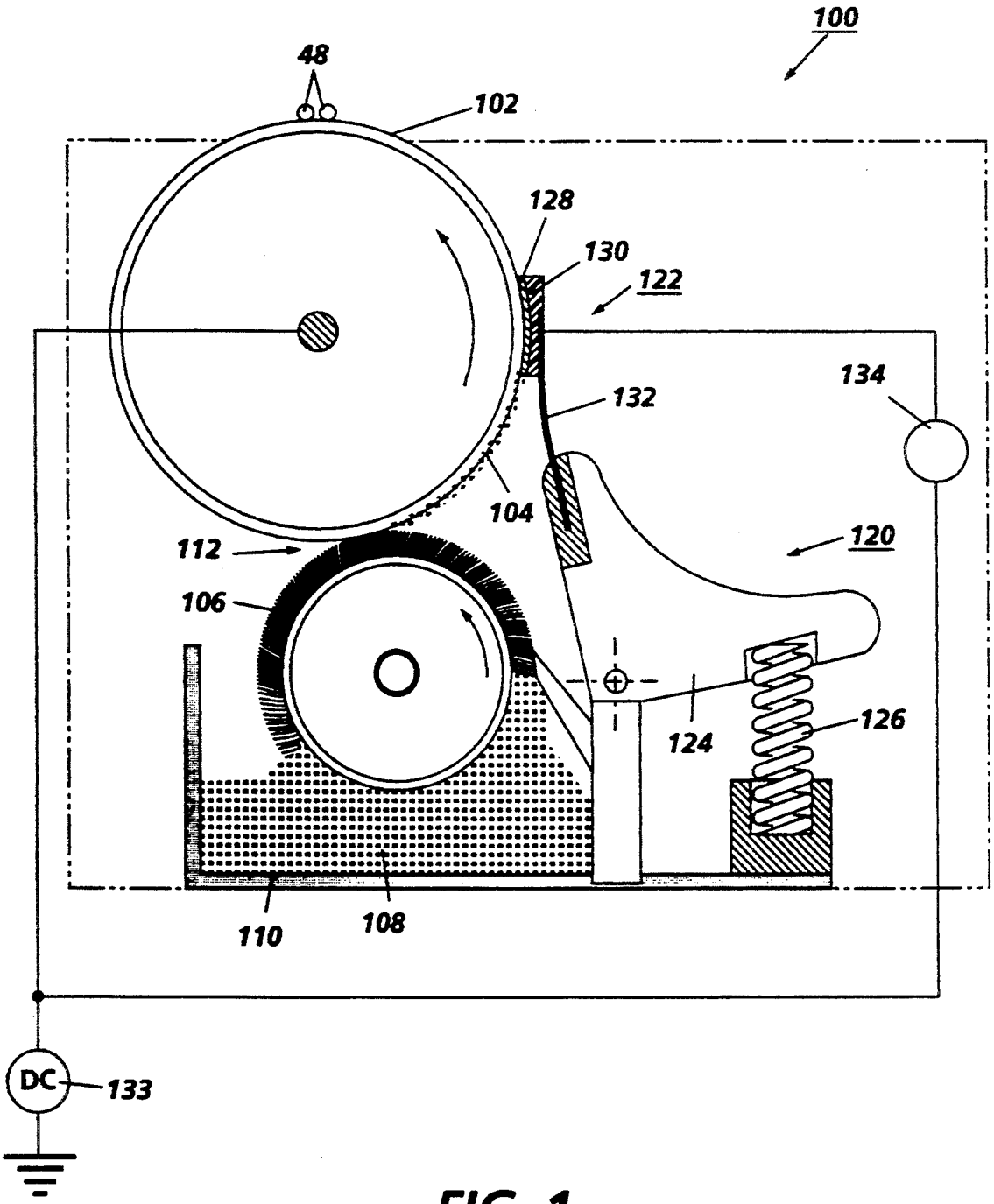
FIG. 1 is schematic illustration of a printing apparatus in which the inventive features of the invention may be employed.

Illustrated in FIG. 1 is a fragmentary schematic view of a development structure 100 according to the invention. The developer structure 100 illustrated in FIG. 2 is similar to developer apparatus 34 shown in FIG. 1, in that it is a scavengeless development system. The developer structure 100 comprises a donor structure in the form of a roller 102 and a pair of scavengeless nip wires forming the electrode structure 48. The donor roll structure 102 conveys developer 104 comprising toner particles deposited thereon via a magnetic brush structure 106 which conveys two component developer material 108 comprising toner and carrier particles from a sump area 110 to a nip 112 disposed between the donor roll 102. Toner particles are deposited onto the surface of the donor roller which is rotated in the counterclockwise direction.

A combination metering and charging structure 120 serves to both meter and charge the toner deposited on the donor roll surface. The structure 120 comprises a blade structure 122 supported in pressure contact with the donor roll by means of a blade holder 124. A bias spring 126 is provided for urging the blade holder 124 in the direction of the donor roll for effecting pressure engagement of a relatively thin conductive member or surface 128 forming an integral part of the blade structure 122. The conductive surface 128 is secured to an elastomeric layer 130 which is, in turn, secured to a support arm 132. The thin conductive layer is used to allow for some conformability from the rubber blade coating. The conformability is desirable for mitigating toner packing in the pretrim area.

A power source 133 is provided for electrically biasing the donor roll structure 102 to a suitable voltage level as known in the art. A power source 134 which is referenced to the donor roll bias 133 as shown in FIG. 1 serves to electrically bias the conductive member 128. The voltage applied to the member 128 is in the order of 0 to 300 volts peak.

Examples of conductive surface materials include suitable for the intended purpose are aluminized mylar, titanium coated mylar, titanium/zirconium coated mylar, titanium/zirconium with a silane blocking layer on mylar, polished stainless steel shim, polished steel shim and carbon black loaded polymer or rubber.

The conductive surface 128 contacts the toner layer on the donor roll for diminishing the properties of the toner which caused it to adversely interact with the electrode wires. Thus, toner agglomeration on the wires 48 and the accompanying uncontrolled powder clouding exhibited by prior art devices was substantially eliminated.

Experiments were performed with 125 micron thick aluminized polyester film inserted between the blade and donor with the aluminum facing the toner. The aluminum was electrically connected to the donor roll-.core bias voltage. No additional effects were observed for DC or AC biases of. Without the conductive surface, all prints had tremendous density uniformity problems. With the conductive surface, multiple prints without defects from toner wire contamination were made.

What is claimed is:

1. In a method for forming images on an image receiving surface with developer, the steps including:

providing a supply of developer;

transporting developer from said supply to an area adjacent said image receiving surface;

providing electrode wires in the said area for forming transported developer into a cloud of marking particles; and conditioning said developer for effecting uniform clouding thereof by means of said electrode wires by using a conductive metering/charging member supported by an elastomeric member.

2. The method according to claim 1 wherein said step of conditioning is effected prior to said developer being transported to said area adjacent said image receiving surface.

3. The method according to claim 1 wherein said step of transporting comprises using a relatively semi-conductive donor roll.

4. The method according to claim 1 wherein said conductive member is secured to said elastomeric member and said elastomeric member is operatively supported for engagement of said conductive member with developer on said donor by means of a flexible arm which is mechanically urged in the direction of said transporting means.

5. The method according to claim 4 including the step of electrically biasing said conductive member.

6. Apparatus for forming images on an image receiving surface with developer, said apparatus comprising:

a supply of developer;

means for transporting developer from said supply to an area adjacent said image receiving surface;

means for forming transported developer into a cloud of marking particles; and means for conditioning said developer effecting uniform clouding thereof by means of said electrode wires, said conditioning means comprising a conductive metering/charging member supported by an elastomeric member.

7. Apparatus according to claim 6 wherein said conductive member is secured to said elastomeric member and said elastomeric member is operatively supported for engagement of said conductive member with developer on said donor by means of a flexible arm which is mechanically urged in the direction of said transporting means.

8. Apparatus according to claim 7 including means for electrically biasing said conductive member.

* * * * *